United States Patent [19]

Levine

[11] Patent Number: 4,944,465

[45] Date of Patent: Jul. 31, 1990

[54] SPRING DRIVING AND WINDING MACHINE

[76] Inventor: Aaron J. Levine, 3180 N. Lake Shore Dr., Apt. 5A, Chicago, Ill. 60657

[21] Appl. No.: 350,409

[22] Filed: May 11, 1989

[51] Int. Cl.[5] ..... B65H 75/36

[52] U.S. Cl. ..... 242/54 R; 242/83; 15/104.33

[58] Field of Search ..... 242/54 R, 83; 15/104.33; 254/134.3 FT, 134.3 SC

[56] References Cited

U.S. PATENT DOCUMENTS

| | | | |
|---|---|---|---|
| D. 238,046 | 12/1975 | Levine . | |
| 2,262,364 | 11/1941 | Hugel et al. | 15/104.33 X |
| 2,272,387 | 2/1942 | Therrien | 242/83 X |
| 2,292,712 | 8/1942 | O'Leary | 242/83 X |
| 2,552,808 | 5/1951 | O'Brien | 242/83 X |
| 2,953,799 | 9/1960 | Arnold | 15/104.33 |
| 3,130,432 | 4/1964 | Prange | 242/54 R |
| 3,258,955 | 7/1966 | Lindsay . | |
| 3,394,422 | 7/1968 | Siegal | 242/54 R X |
| 3,809,366 | 5/1974 | Crees | 15/104.33 X |
| 3,928,885 | 12/1975 | Peterson et al. | 242/54 R X |
| 3,942,238 | 3/1976 | Dore . | |
| 4,095,326 | 6/1978 | Harvey . | |
| 4,290,162 | 9/1981 | Agostino | 15/104.33 |
| 4,377,893 | 3/1983 | Buonanno . | |

*Primary Examiner*—John M. Jillions

*Attorney, Agent, or Firm*—Hill, Van Santen, Steadman & Simpson

[57] ABSTRACT

A spring snake driving and winding machine for a plumbing cleanout tool which has a pair of rollers of which at least one is driven so as to drive a cleanout snake into the plumbing cleanout tool so as to rapidly coil it. The rollers can be moved apart to allow the snake to be initially mounted in the machine.

4 Claims, 1 Drawing Sheet

SPRING DRIVING AND WINDING MACHINE

BACKGROUND OF THE INVENTION

1. Field of the Invention:

This invention relates in general to a spring driving and winding machine for winding plumbing cleanout snakes into a plumbing cleanout device.

2. Description of Related Art

U.S. Pat. No. Des. 238,046, of which the inventor is the same as the present application discloses a plumbing cleanout device in which a cleanout snake is mounted which can be selectively removed and used to cleanout a water pipe, for example. Previously, the coiled cleanout snake was manually inserted into the plumbing cleanout device and this required a substantial time to manually insert each such cleanout snake. The following patents relate to coiling wires, U.S. Pat. Nos. 3,258,955, 3,942,238, 4,095,326 and 4,377,893.

SUMMARY OF THE INVENTION

The present invention relates to a machine for driving and winding a spring snake into a plumbing cleanout tool. The machine comprises a pair of rollers at least one of which is driven between which the snake can be clamped so as to drive it toward a plumbing cleanout tool into which the snake is to be inserted. The plumbing cleanout tool has a reservoir with a rear opening into which a centering cone can be inserted and which is rotatably supported so as the coil of wire is inserted into the cleanout tool, the reservoir for the coil can rotate. Also, the cone serves as a guide to deflect the end of the coil to the outer confines of the housing of the cleanout tool so that it will coil in the reservoir.

It is an object of the invention to provide an improved spring driving and winding machine which allows snake coils to be rapidly wound into a plumbing cleanout reservoir.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENTS

Figure 1:
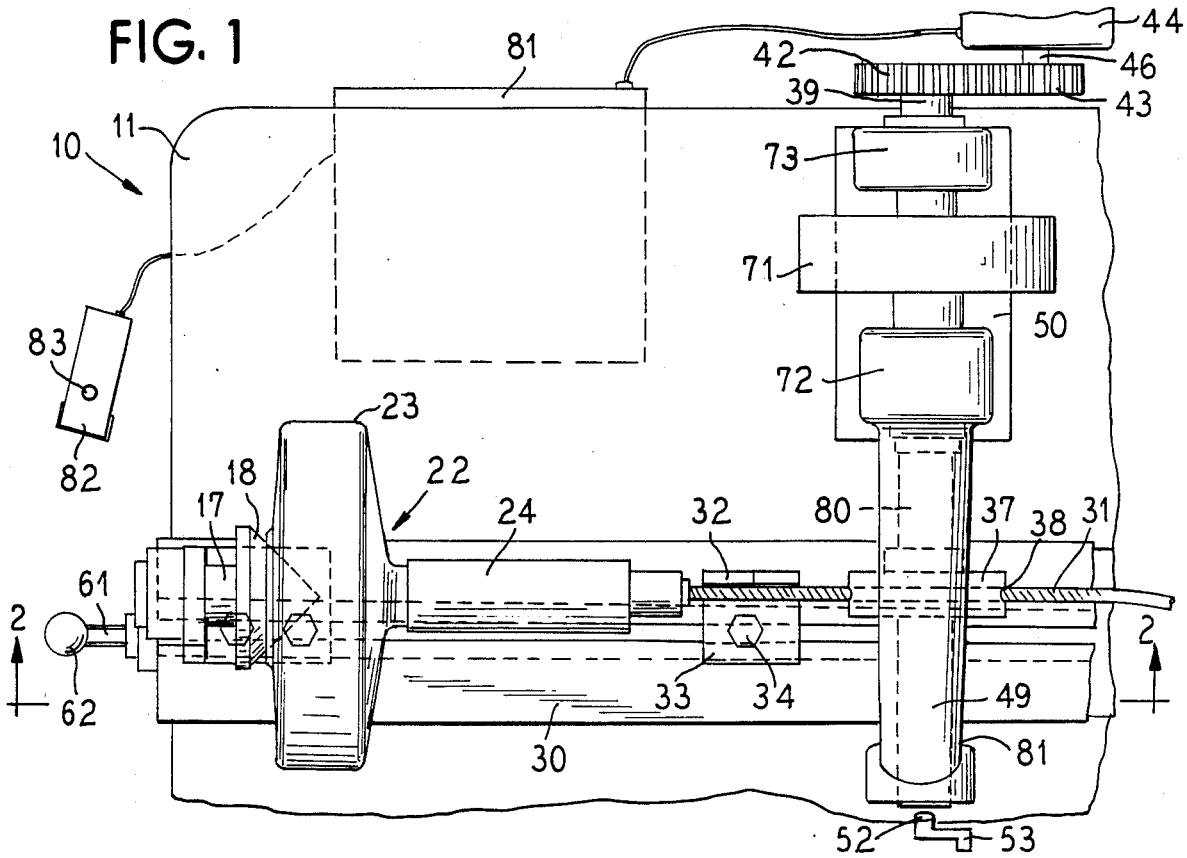
FIG. 1 is a top plan view of the spring driving and winding machine of the invention.
Figure 2:
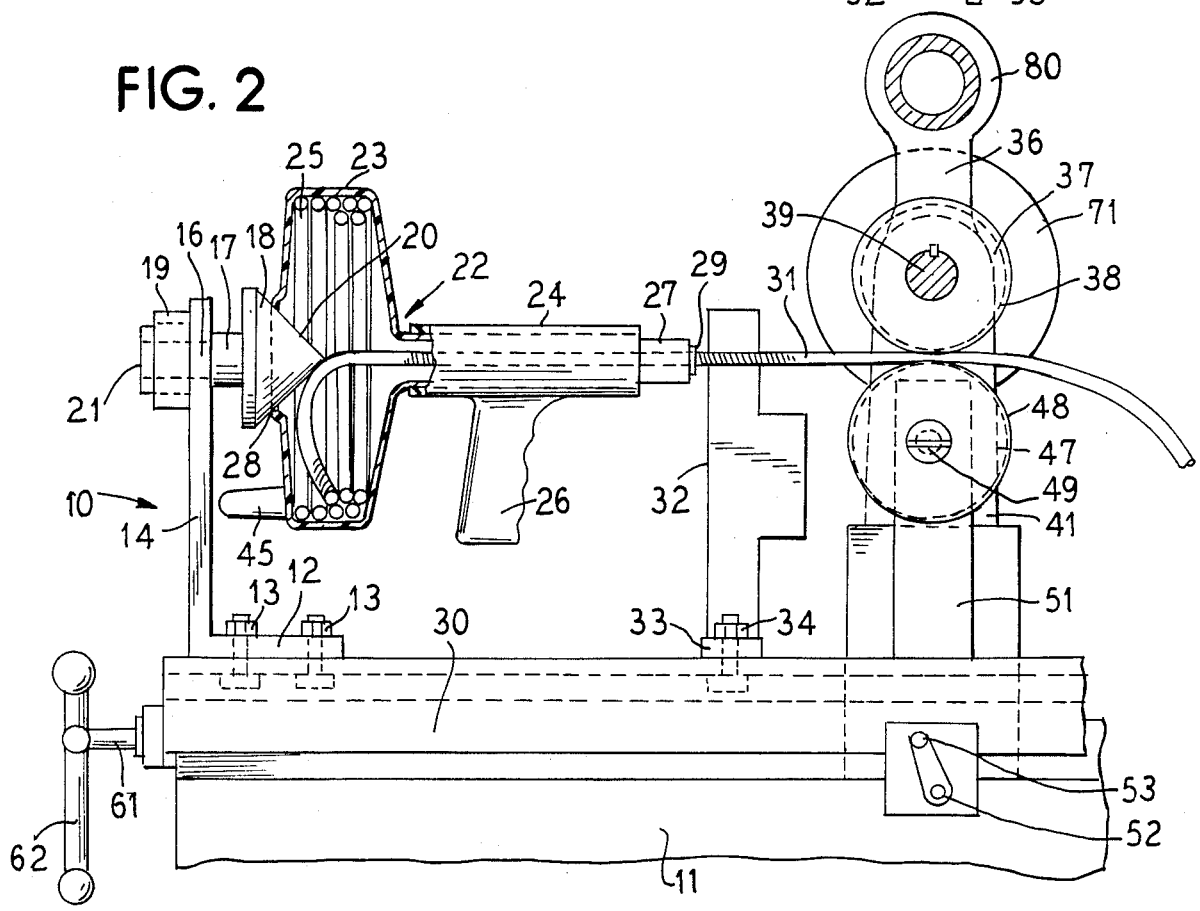
FIG. 2 is a side plan view of the invention.

FIG. 1 illustrates the spring driving and winding machine 10 of the invention which comprises a base 11 upon which may be mounted the bed 30 of a milling machine, for example. An L-shape upright guide 14 has its base 12 connected by bolts 13 to the bed 30 of the machine. An upright portion 14 rotatably supports a shaft 16 which carries a rotatable cone 18 that has a collar 17 connected to shaft 16. A bearing 19 and nut 21 rotatably connects the shaft 16 to the upright 14. A plumbing cleanout tool 22 such as is shown in U.S. Pat. No. Des. 238,046 has a cylindrical portion 24 with a handle 26 that rotatably supports a rotatable member 27 which extends through the member 24 and which is attached to a spring reservoir 23 into which the coils 25 of a snake 31 can be inserted. The reservoir 23 is formed with an opening 28 into which the tapered end 20 of the cone 18 can be inserted as best shown in FIG. 2. A handle 45 is attached to the reservoir 23 so as to rotate it when in use for cleaning out water pipes, for example. A guide member 32 is formed with a base 33 which is connected by bolts 34 to the machine 30 and may engage the snake 31.

A pair of rollers 37 and 47 are rotatably supported by the machine 30 above each other and are formed with concave outer edges 38 and 48 between which the coiled wire 31 of the snake can be received. The upper roller 37 is rotatably supported on a shaft 39 which extends through a bearing support 72 and carries a flywheel 71. The shaft 39 also extends through a second bearing 73 as shown in FIG. 1. A gear 42 is mounted on shaft 39 and meshes with a gear 43 mounted on the shaft 46 of a driving motor 44. The driving motor 44 is connected to a power supply 81 and to a switch 82 which has an actuating button 83. The switch 82 is connected to the power supply 81 to energize the motor 44 when the switch 82 is closed.

The lower roller 47 is mounted on the base 30 so that it can be vertically moved and is supported by an upright 51 which rotatably supports the shaft 49 upon which the roller 47 is mounted. A crank shaft 52 is coupled to the upright 51 and has a handle portion 53 which allows the upright 51 to be moved so that the roller 47 can be moved relative to the roller 37 to selectively clamp the snake 31 between the rollers 37 and 47. The mechanism for moving the upright 51 may comprise a conventional mechanism of a milling machine such as a rack and pinion and is not described in detail herein.

A shaft 61 has a crank 62 for moving the bed 30 of the machine in a conventional manner so as to move the upright 14 relative to the rollers 37 and 47.

In use the crank 53 is rotated so as to move the upright 51 downwardly and the roller 47 away from the roller 37 so that a coiled wire snake 31 can be inserted between the rollers 37 and 47 after which the roller 47 is moved upwardly to clamp the snake 31 between rollers 37 and 47. The end 25 of the snake is inserted into the opening of the member 29 of the plumbing cleanout tool 22 and the end 25 engages the pointed surface 20 of the cone 18 and is deflected out toward the outer periphery of the holding magazine 23 for the coil. Then the switch button 83 is depressed to close the switch 82 which starts the motor 44 to drive the upper roller 37 which will drive the snake 31 into the reservoir 23. Driving continues until a suitable length of the snake is stored in the reservoir 23. The operator can hold the plumbing tool 22 by the handle 26 as this is accomplished and the guide 32 assists in keeping the snake straight. When the snake 31 has been substantially stored in the reservoir 23, the switch 82 is opened and the motor 44 stops so as to discontinue drive of the roller 37. Then the roller 47 may be moved away from the roller 37 by using the crank 53 to move roller 47 downwardly and the plumbing tool 22 can be removed from the cone 18 of the machine. Thus, the snake 31 is coiled into the reservoir 23 of the plumbing tool and the plumbing tool is then ready for use. Another empty plumbing tool 22 can then be mounted on the cone 18 and a second snake 31 can be clamped between the rollers 37 and 47 and its end inserted into the member 29 of the plumbing tool so as to coil the snake to be coiled into the second plumbing tool.

This invention allows rapid loading and coiling of the snake 31 into the plumbing tool 22. The snake may be made of coiled steel wire, for example.

Although the invention has been described with respect to preferred embodiments, it is not to be so limited as changes and modifications can be made therein which are within the full intended scope as defined by the appended claims.

I claim as my invention:

1. A spring snake driving and winding machine for a plumbing cleanout tool including a snake magazine formed with an opening comprising, a base, a first upright member supported from said base, a conical member rotatably supported by said first upright member, a pair of rollers formed with concave edges rotatably supported by said base above each other and moveable relative to each other so as to clamp said spring snake therebetween, a drive means connected to at least one of said pair of rollers, and said plumbing cleanout tool mountable on said machine with said conical member extending partially within said opening of said magazine of said plumbing cleanout tool so that said spring snake can be loaded into said magazine as said driving means is energized.

2. A spring snake driving and winding machine according to claim 1 including an upright guide mounted on said base and engageable with said spring snake between said pair of rollers and said plumbing cleanout tool.

3. A spring snake driving and winding machine according to claim 1 wherein one of said pair of rollers is mounted above the other roller and said one roller is driven by said drive means.

4. A spring snake driving and winding machine according to claim 3 wherein said other roller is rotatably supported on a vertically adjustable support from said base.

* * * * *